United States Patent [19]

Huston

[11] 3,978,871

[45] Sept. 7, 1976

[54] NAIL POLISH BOTTLE OPENER AND NAIL CARE IMPLEMENT

[75] Inventor: Robert B. Huston, Pompano Beach, Fla.

[73] Assignee: Lawrence Peska Associates, Inc., New York, N.Y. ; a part interest

[22] Filed: Oct. 1, 1975

[21] Appl. No.: 618,318

[52] U.S. Cl. ..... 132/73

[51] Int. Cl.[2] ..... A45D 29/00

[58] Field of Search ..... 132/73, 73.5, 73.6; 401/126

[56] References Cited

UNITED STATES PATENTS

| | | | |
|---|---|---|---|
| 1,980,878 | 11/1934 | Robinson | 401/126 |
| 2,195,495 | 4/1940 | Popp | 132/73 X |
| D116,066 | 8/1939 | Twomey | 132/88.7 UX |

*Primary Examiner*— G.E. McNeill

*Attorney, Agent, or Firm*—Jack D. Slobod

[57] ABSTRACT

An opener for a nail polish bottle includes a collar with a conical bore having a grooved surface for engaging the grooved surface of an upwardly converging cap on a nail polish bottle. A pair of opposed integral arms or wings project outward and upward from the collar and respectively carry a nail filing surface and a buffing cloth surface.

3 Claims, 3 Drawing Figures

NAIL POLISH BOTTLE OPENER AND NAIL CARE IMPLEMENT

FIELD OF THE INVENTION

The present invention relates generally to jar wrenches. In its particular aspects the present invention relates to a wrench configured for opening a nail polish bottle which wrench carries a nail care implement.

BACKGROUND OF THE INVENTION

It is frequently difficult to remove the cap on a nail polish bottle because of the tendency of the polish to harden between the opposed threads of the cap and bottle. Because of the unusual upwardly converging shape of the cap, conventional jar wrenches will not work on the cap. Further, various nail care implements such as nail filing means and buffing means are easily misplaced.

OBJECTS OF THE INVENTION

It is an object of the present invention to provide a decorative wrench device configured for opening a nail polish bottle.

It is a further object of the present invention to provide a nail polish bottle wrench which carries nail care implements which are utilized in conjunction with the application of polish to the nails.

SUMMARY OF THE INVENTION

Briefly, the aforementioned and other objects of the present invention are satisfied by providing a wrench device including a collar having a conical bore. The bore has a grooved surface for engaging the grooved exterior surface of the usual upwardly converging nail polish bottle cap.

For leverage, a pair of arms project from the collar in diametric opposition. One of the arms carries a nail filing means and the other arm carries a nail buffing means to make readily available the implements which are used prior to and subsequent to the application of polish to the nails.

Other objects, features and advantages of the present invention will become apparent upon perusal of the following detailed description of the preferred embodiment thereof when taken in conjunction with the appended drawing wherein.

DETAILED DESCRIPTION

Figure 1:
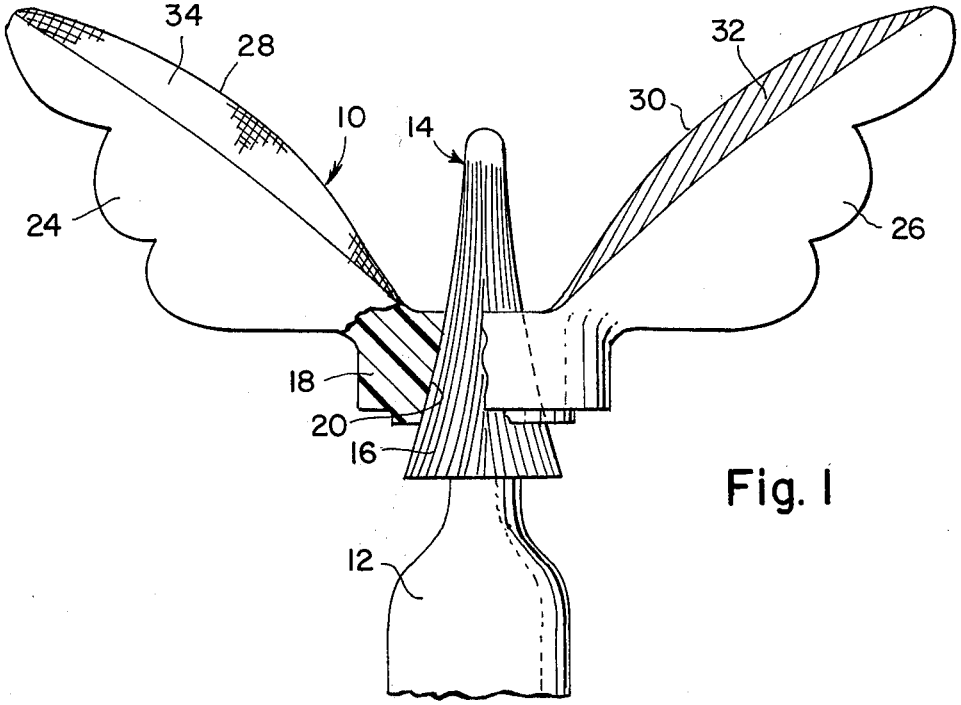
FIG. 1 is an elevational view, partially broken away in cross-section, of the wrench device of the present invention positioned for use on a nail polish bottle.
Figure 2:
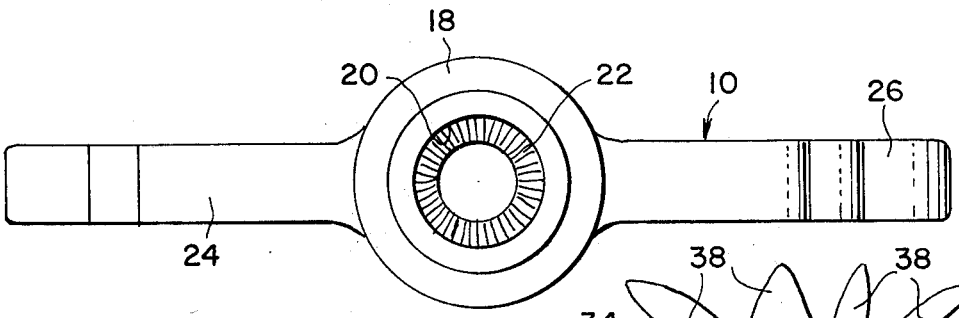
FIG. 2 is a view of the bottom of the wrench device in FIG. 1.

Referring first to FIGS. 1 and 2 of the drawing the wrench of the present invention is generally indicated by reference numeral 10. Wrench 10 is preferably a rigid plastic item configured for opening a nail polish bottle 12 having an upwardly converging or generally conical cap 14. As is usual, the cap 14 has longitudinally directed grooves 16 distributed over its exterior surface for providing a frictional hand grip.

The wrench 10 comprises a generally cylindrical collar 18 having a frusto-conical bore 20 coaxial with the collar and passing therethrough. It should be noted that the term "conical" will be used herein in its generic sense to also include the term "frusto-conical." As best shown in FIG. 2, a plurality of angularly spaced longitudinally directed grooves 22 are formed on the surface of bore 20 for engagement with the grooves 16 on cap 14. Thus, because of the conical nature of cap 14 and 20 the collar 18 may be slipped over the top of cap 14 and pressed downward into tight frictional engagement with the cap.

Left and right arms 24 and 26 project integrally from the collar 18 both upward and in diametrically opposite radial directions for enabling the exercise of leverage about collar 18. As best shown in FIG. 1, the arms 24 and 26 may be provided with the decorative shape of butterfly wings respectively having top arcuate edges 28 and 30.

In order to prepare and shape the nails prior to the application of polish thereto from bottle 12 a roughened surface 32 is formed along the top edge 30 of arm 26 for filing the nails. The surface 32 is preferably formed integrally on arm 26 as a sharply corrugated surface in the nature of a file or a pebbly surface in the nature of an emery board. Alternatively, emery paper (not shown) may be adhesively secured to arm 26 to form surface 32.

After the applied polish to the nails has dried, the nails may be shined by a buffing surface 34 along edge 28 on arm 24. Surface 34 may be formed by the adhesive lamination of a cloth or felt on arm 24.

Figure 3:
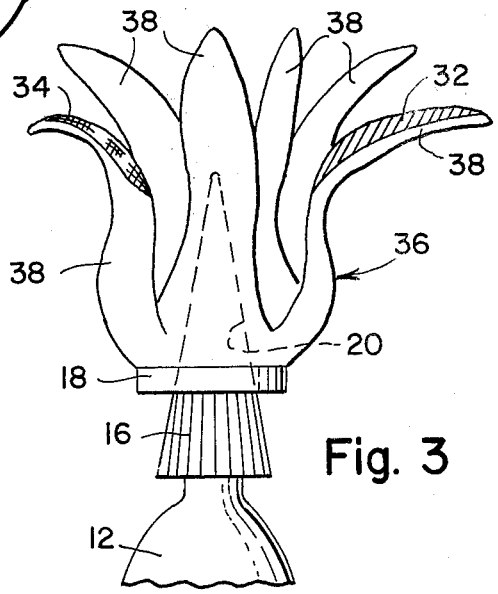
FIG. 3 is a view similar to FIG. 1 but with a wrench according to an alternate embodiment.

In FIG. 3, there is shown an alternate design wrench 36 in which the collar 18 is of a somewhat conical shape and the conical bore 20 includes an apex within the collar. Further rather than just two arms, several angularly arms 38 project upward and radially from the central collar 18. In this design the arms 38 are shaped in the nature of the petals of a tulip and carry different nail care surfaces such as filing surface 32 and buffing surface 34.

While the preferred embodiments of the present invention have been described in specific detail, it should be understood that numerous modifications, additions and omissions in the details thereof are possible within the intended spirit and scope of the invention claimed herein.

What is claimed is:

1. A decorative wrench device for opening a nail polish bottle having an upwardly converging cap with a grooved surface comprising: a collar; a generally conical bore in said collar, said bore having a grooved surface for engaging said cap; an arm projecting integrally from said collar; and nail filing means on said arm.

2. The device of claim 1 wherein said filing means comprises an emery board formed on said arm.

3. The device of claim 1 wherein a second arm projects from said collar diametrically opposite said first arm, and wherein said second arm carries a nail buffing means.

* * * * *